US006677564B1

(12) United States Patent
Sohn et al.

(10) Patent No.: US 6,677,564 B1
(45) Date of Patent: Jan. 13, 2004

(54) BLOWER APPARATUS

(75) Inventors: Sang-Bum Sohn, Seoul (KR); Wan-Ho Jeon, Incheon (KR); Ho-Seon Rew, Seoul (KR); Seung-Bae Song, Anyang (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/320,484

(22) Filed: Dec. 17, 2002

(30) Foreign Application Priority Data

Jul. 24, 2002 (KR) ..... 10-2002-0043654

(51) Int. Cl.[7] ..... H05B 6/80; F01D 1/02

(52) U.S. Cl. ..... 219/757; 126/299 R; 415/204; 415/212.1; 29/889.4

(58) Field of Search ..... 219/757, 400; 126/299 R, 299 D, 21 A; 415/203, 204, 205, 206, 212.1; 29/889.4, 889.3

(56) References Cited

U.S. PATENT DOCUMENTS 5,839,879 A * 11/1998 Kameoka et al. ..... 415/206
5,951,907 A * 9/1999 Kang ..... 219/757
6,200,093 B1 3/2001 Lee et al. ..... 415/204

* cited by examiner

*Primary Examiner*—Philip H. Leung
(74) *Attorney, Agent, or Firm*—Greenblum & Bernstein, P.L.C.

(57) ABSTRACT

A blower apparatus which is used inside an Over-The-Range (OTR) microwave oven and the like, includes a centrifugal fan, a bracket which is fixed and combined with a side of the driving unit and a fan housing having a suction port which rotably accommodates the centrifugal fan, is fixed and combined with the bracket, and is formed in the shaft direction of the centrifugal fan, for sucking gas by rotation of the centrifugal fan, and a discharge port for discharging gas which is sucked through the suction port, being formed vertically to the suction port. The edge of the discharge port is formed in a convex shape in the shaft direction by the first inclined surface of a protrusion portion which is protruded in the shaft direction from the bracket and second inclined surface formed in the fan housing, and an inflection point is formed at the contact point of the first inclined surface and second inclined surface.

19 Claims, 5 Drawing Sheets

BLOWER APPARATUS

BACKGROUND OF THE INVENTION

1. Field of the Invention

The present invention relates to a blower apparatus and particularly, to a blower apparatus which is used in an Over-The-Range (OTR) microwave oven and the like.

2. Description of the Related Art

Generally, an OTR microwave oven is a domestic appliance which is installed over a gas range installed in a kitchen, for performing a cooking function using microwave in a cavity, and at the same time a ventilating function for sucking/discharging combustion gas or polluted air in the kitchen which are generated in a gas range which is installed at the lower side of the OTR microwave oven using a blower apparatus installed therein.

FIG. 1 shows a conventional OTR microwave oven, and it will be described as follows.

As shown in FIG. 1, the conventional OTR microwave oven includes a main body 1 having a cooking space C in which cooking is performed therein by microwave, an outer casing 3 in which the main body 1 is positioned and a flow path 2 is formed at both sides of the main body 1, and a blower apparatus 4 which is installed at the upper rear side of the main body 1.

A rotary tray 5 is rotatably installed inside the cooking space C to rotate food accommodated inside the cooking space C, and a magnetron 8 for generating microwave induced into the cooking space C in case of cooking is installed at the outer side of the cavity.

In addition, an air suction port 6 connected with the flow path 2 is formed at the lower side of the outer casing 3, and an air discharge port 7 for discharging air to the outside is formed on the upper rear surfaces. Here, the air discharge port 7 is connected with a ventilating duct by a connection duct (not shown) such as a building and the like, for the convenience of a user, or the air can be circulated indoors as the air passes through a filter (not shown) which is installed on a front surface of the outer casing 3 by mounting a discharge port of the blower apparatus 4 on the front surface in a building without the ventilating duct.

The conventional OTR microwave oven with the above composition is installed over a gas range, and performs functions of a hood for ventilating smoke and smell generated in cooking by the user as well as the original functions of the microwave oven.

The conventional OTR microwave oven rotates food as the rotary tray 5 rotates when a user opens a door (not shown), puts food on the rotary tray 5 in the cooking space C, closes the door, and pushes an operation button in the adjusting plate (not shown), and at the same time, microwave is generated in a magnetron 8. Therefore, the microwave is induced into the cooking space C, and the microwave oven performs its original function of cooking food using microwave.

Also, when a user pushes a hood operation button on the operation panel, a suction force is generated as the blower apparatus 4 installed in the microwave oven is operated, and as shown dotted lines in FIG. 1, the conventional OTR microwave oven sucks combustion gas and polluted air generated in cooking using the gas range which is installed at the lower side through the air suction port 6 which is formed on the lower surface of the outer casing 3. The sucked air is ventilated by being discharged to the outside through the air discharge port 7 which is formed on the upper surface of the outer casing 3 through the flow path 2 or is circulated indoors.

Meanwhile, as shown in FIGS. 2 and 3 the blower apparatus 4 of the conventional OTR microwave oven includes a bracket 42 which is combined with both sides of the motor 41 positioned in the center portion, a centrifugal fan 43 which is combined with a rotation shaft (not shown) of the motor 41 which is protruded to the outer side of the center portion of the bracket 42, and a cylindrical fan housing 44 having a side which is fixed with the bracket 42, which is combined to cover an outer side of the centrifugal fan 43.

In the fan housing 44, a suction port 45 for sucking air is formed at the outside, and a discharge port 46 for discharging the sucked air of the suction port 45 is formed in the vertical direction to the suction port 45.

Also, a cut-off portion 47 for guiding the discharged air is formed at a side of the discharge port 46.

In the conventional blower apparatus 4 with the above composition, the centrifugal fan 43 which is shaft-coupled with the motor 41 rotates when the motor 41 rotates as a power source is applied, and the outer air is sucked into the inside the fan housing 44 through both suction ports 45 of the fan housing 44 as a suction force is generated by rotation of the centrifugal fan 43.

In addition, the air sucked into the fan housing 44 through the suction port 45 is discharged to the discharge port 46 which is formed in the vertical direction of the suction port 45 by the rotation force of the centrifugal fan 43.

However, in the conventional ventilating fan 4, air flow which is formed by rotation of the centrifugal fan 43 forms a wide loss regions by growth of the boundary layer in the edge portion of the discharge port 46, and such flow loss in the discharge port 46 hinders the blowing amount, and increases blade passing frequency (hereinafter, as BPF) noise of the centrifugal fan 43.

As a method for solving the above problem, the present applicant has suggested a method for forming the cut-off portion as a "V" shape in the discharge port 46 disclosed in U.S. Pat. No. 6,200,093.

However, in case of manufacturing the fan housing in which the 'V'-shaped discharge port suggested by the present applicant by plastic injection molding, an under cut was generated, and accordingly, designing of the plastic injection molding which can be mass-produced was difficult since a loose core or slide core and the like must be installed and used in the metallic patterning of the fan housing.

SUMMARY OF THE INVENTION

Therefore, an object of the present invention is to provide a blower apparatus having a structure with which a fan housing having a 'V'-shaped discharge port therein can be easily manufactured by injection molding of plastic without installing a loose core or slide core.

To achieve these and other advantages and in accordance with the purpose of the present invention, as embodied and broadly described herein, there is provided a blower apparatus, including a centrifugal fan, a driving unit for rotating the centrifugal fan, a bracket combined with a side of the driving unit, and a fan housing receiving the centrifugal fan, the fan housing being combined with the bracket, and having a suction port formed in a shaft direction of the centrifugal fan for sucking gas by rotation of the centrifugal fan, and a discharge port formed vertically to the suction port for discharging gas sucked through the suction port, wherein an edge of the discharge port is in a convex shape in the shaft direction formed by a first inclined surface of a protrusion portion which is protruded in the shaft direction from the bracket and a second inclined surface in the fan housing.

The centrifugal fan, bracket and fan housing can be installed as a pair at both sides of the driving unit.

The present invention also provides a method for manufacturing a blower apparatus which includes a centrifugal fan, a bracket combined with a side of the driving unit, and a fan housing being combined with the bracket, receiving the centrifugal fan, the fan housing being combined with the bracket, and having a suction port formed in a shaft direction of the centrifugal fan for sucking gas by rotation of the centrifugal fan, and a discharge port formed vertically to the suction port for discharging gas sucked through the suction port, by forming an edge of the discharge port in a convex shape in the shaft direction with a first inclined surface of a protrusion portion which is protruded in the shaft direction from the bracket and a second inclined surface in the fan housing.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A blower apparatus in accordance with the present invention is operated similarly to the conventional one, and accordingly description of the operation of the blower apparatus will be omitted for the simplicity purpose.

Figure 1:
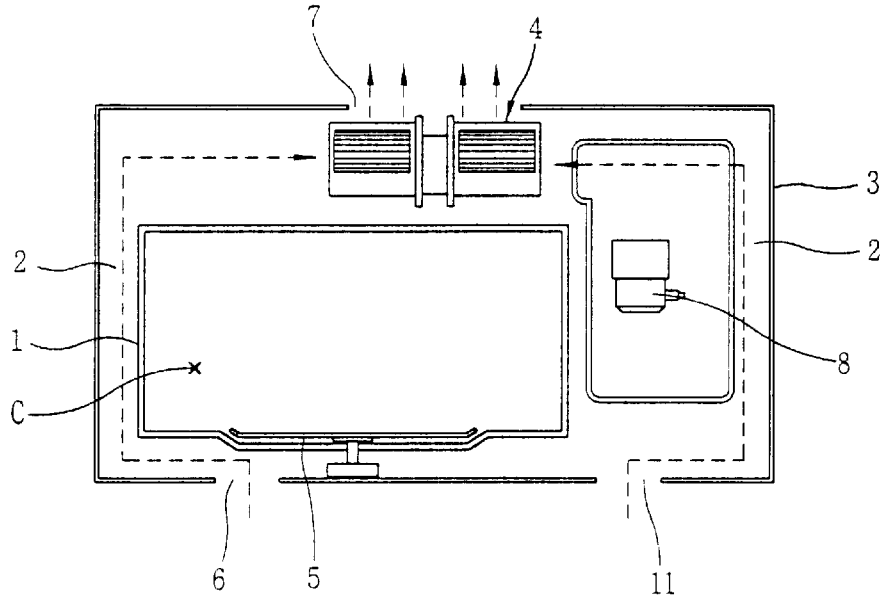
FIG.1 CONVENTIONAL ART
FIG. 1 is a front view showing a conventional over-the-range (OTR) microwave oven in which a conventional blower apparatus is installed.
Figure 2:
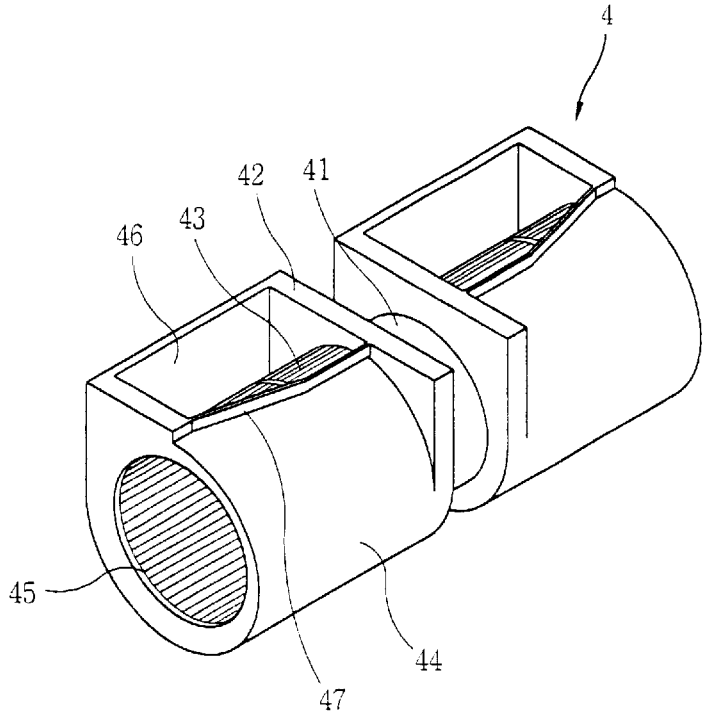
FIG.2 CONVENTIONAL ART
FIG. 2 is a perspective view showing the conventional blower apparatus used in the OTR microwave oven of FIG. 1.
Figure 3:
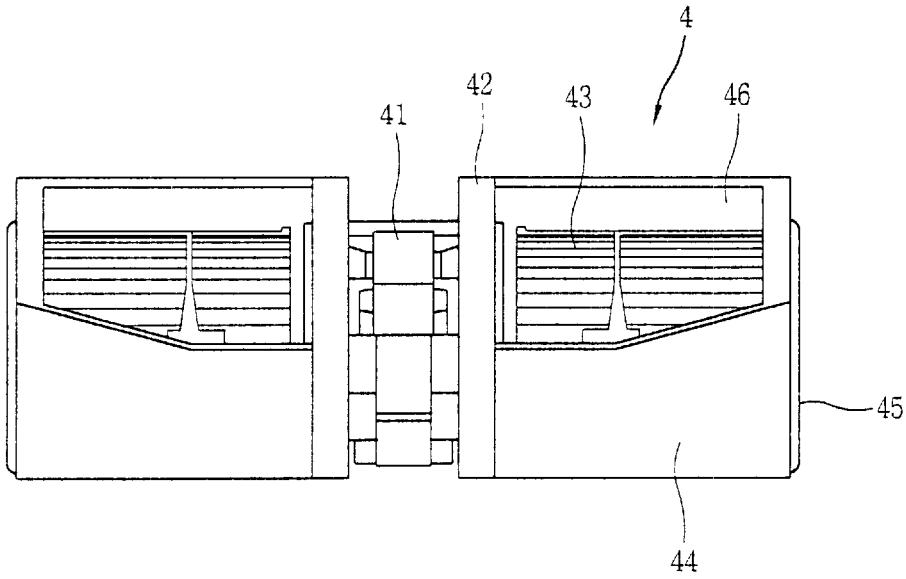
FIG.3 CONVENTIONAL ART
FIG. 3 is a plan view showing the blower apparatus of FIG. 2.
Figure 4:
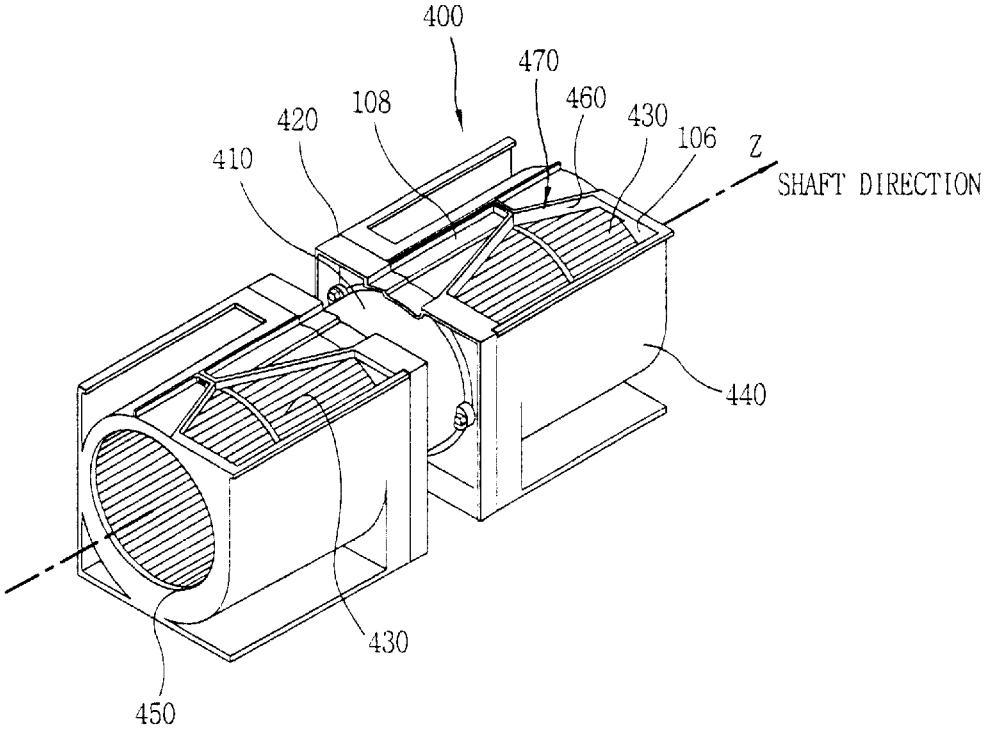
FIG. 4 is a perspective view showing a blower apparatus in accordance with the present invention.

As shown in FIG. 4, the blower apparatus in accordance with the present invention includes a pair of centrifugal fans 430, a driving motor 410 for rotating the centrifugal fan 430, a bracket 420 which is fixed and combined with a side of the driving motor 410, and a pair of fan housings 440 being combined with the bracket 420 and receiving the centrifugal fan 430, the fan housing 440 having a suction port 450 combined with the bracket 420 and formed in the shaft direction of the centrifugal fan 430, for sucking gas by rotation of the centrifugal fan 430, and a discharge port 460 formed vertically to the suction port 450 for discharging gas sucked through the suction port 450.

Figure 5A:
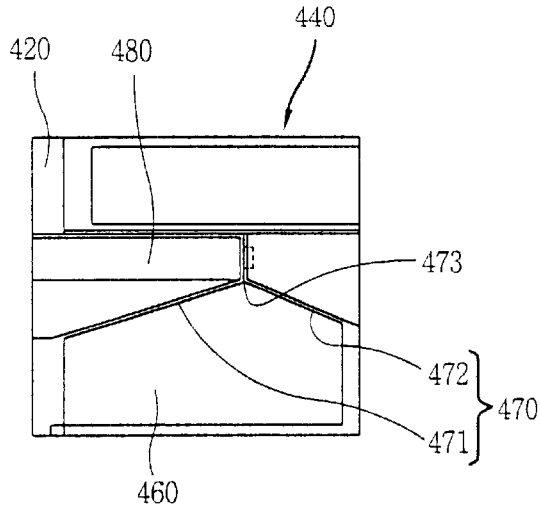
FIG. 5A is a plan view showing an assembling state of a bracket and fan housing in the blower apparatus of FIG. 4.

The discharge port 460 has an edge in which a cut-off portion 470 is formed to smoothly discharge air. As shown in FIG. 5A, the cut-off portion 470 is formed in a convex shape in the shaft direction Z by a first inclined surface 471 of a protrusion portion 480 which is protruded in the shaft direction Z from the bracket 420 and a second inclined surface 472 formed in the fan housing 440, and a portion which is bent at the contact point 473 of the first inclined surface 471 and the second inclined surface 472, that is, an inflection point is formed.

Figure 5B:
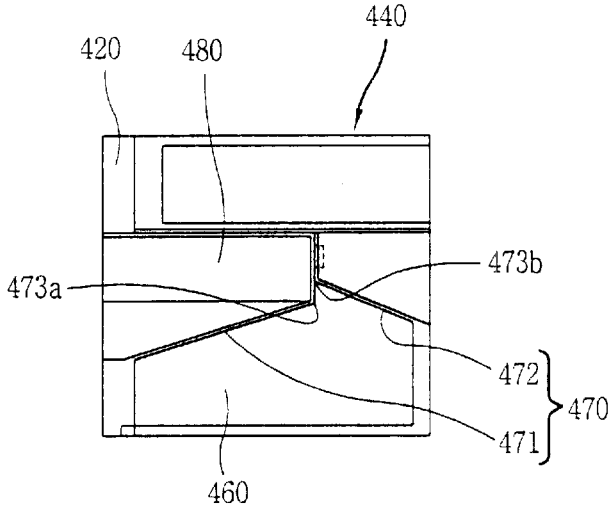
FIG. 5B is a plan view showing an assembling state of a bracket and fan housing in another blower apparatus of FIG. 4.
Figure 5C:
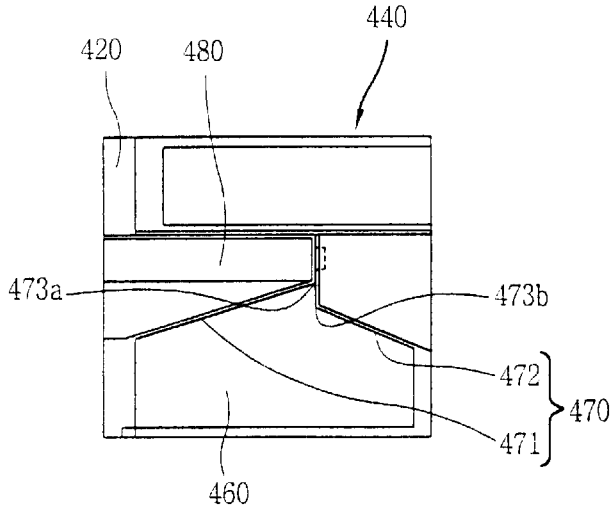
FIG. 5C is a plan view showing an assembling state of a bracket and fan housing in the other blower apparatus of FIG. 4.

In addition, the end points 473*a* and 473*b* of the first inclined surface 471 and the second inclined surface 472 may deviate from each other as shown in FIGS. 5B and 5C.

The shape of the cut-off portion 470 forms a 'V' shape or a 'U' shape, and the contact point 473 of the first inclined surface 471 and the second inclined surface 472 is formed in a bent portion. The first inclined surface 471 and the second inclined surface 472 can be formed as a straight or curved line.

Figure 7:
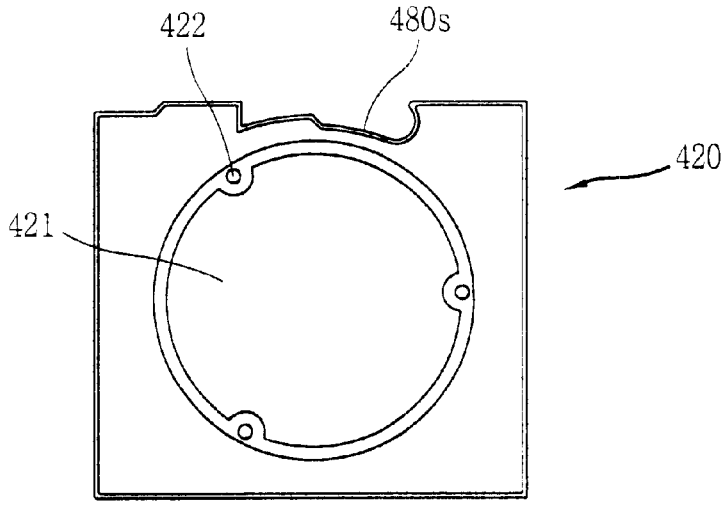
FIG. 7 is a plan view showing the bracket of the blower apparatus of FIG. 4 in a shaft direction.

As shown in FIG. 7, the pair of brackets 420 are respectively fixed and combined with the both sides of the driving motor 410 by connecting member (not shown) such as a bolt, etc., and a combining portion 422 which is fixed and combined with the driving motor 410 is formed at the edge which forms the circumference of the opening portion 421 in which the driving motor 410 is inserted.

The protrusion portion 480 which is formed in the bracket 420 is formed extended in the rotation direction Z of the centrifugal fan 430, and has the first inclined surface 471 which forms the edge of the discharge port 460. The rest portion is abutted on the fan housing 440. In a part of the protrusion portion 480, a fixing unit for mutually combining the bracket 420 and the fan housing 440 can be installed.

Figure 6:
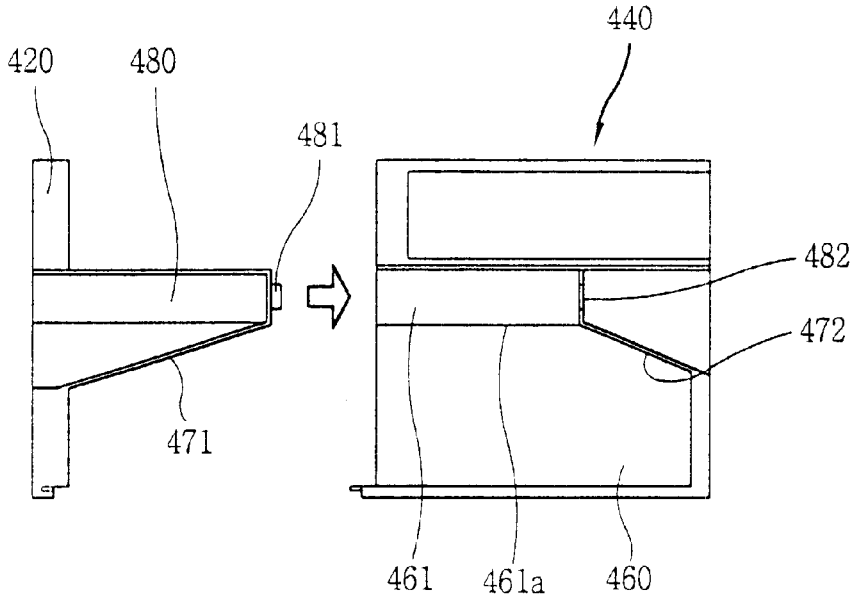
FIG. 6 is a plan view showing an disassembling state of a bracket and fan housing in the blower apparatus of FIG. 4.

As shown in FIG. 6, the fixing unit includes a fixing protrusion portion 481 which is protruded and formed in the shaft direction Z of the centrifugal fan 430 is abutted on the fan housing 430 at an end portion of the protrusion portion 480, and an insertion portion 482 which is formed in a portion on which end portion of the protrusion portion 480 and in which a fixing protrusion portion 481 is inserted.

Figure 8:
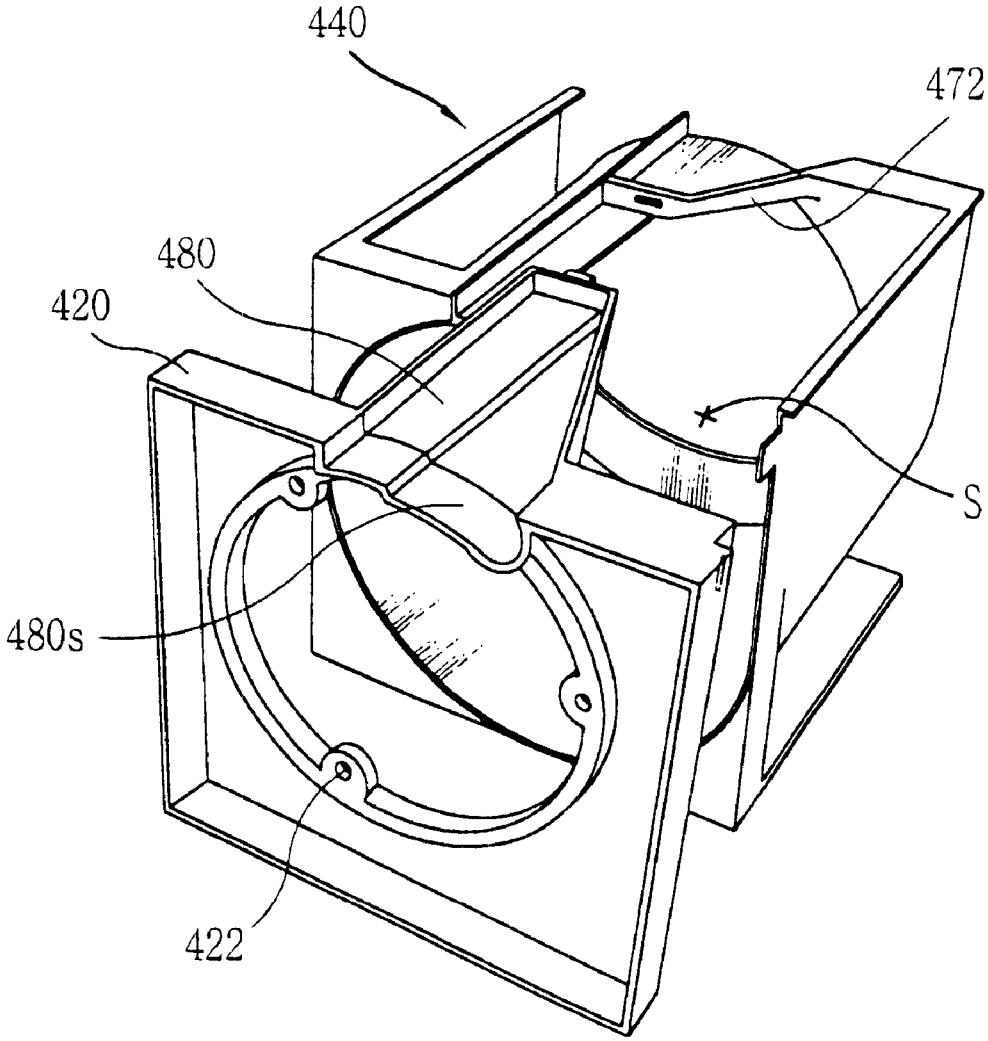
FIG. 8 is a perspective view showing the bracket and fan housing in the lower apparatus of FIG. 4.

Also, as shown in FIG. 8, the inner side surface 480*s* of the protrusion portion 480 can be formed as a part of the cylindrical receiving space S of the centrifugal fan 420 which will be described as follows.

As described above, in the fan housing 440, the cylindrical receiving space S which is combined with the bracket 420, for rotably receiving the centrifugal fan 430 is formed and the discharge channel (not shown) which is connected with the discharge port 460 is formed in the outer circumferential portion of the centrifugal fan 430.

Particularly, a combining portion 461 having an edge 461*a* which is parallel with the rotation shaft Z of the centrifugal fan 430 can be formed at the lower side of the protrusion portion 480 of the bracket 420 to smoothly form the discharge channel.

As described above, the cut-off portion which is formed in the discharge port is designed as a 'V' shape when the fan housing is assembled in the bracket by integrally forming the cut-off portion of the blower apparatus in accordance with the present invention and the protrusion portion having the first inclined surface, and by forming the second inclined surface on a side surface of the discharge port of the fan housing. Therefore, manufacturing of the bracket and fan housing by injection molding is enabled and mass production of parts can be performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A blower apparatus, including:

a centrifugal fan;

a driving unit for rotating the centrifugal fan;

a bracket combined with a side of the driving unit; and a fan housing being combined with the bracket, receiving the centrifugal fan and having a suction port formed in a shaft direction of the centrifugal fan for sucking gas by rotation of the centrifugal fan, and a discharge port formed vertically to the suction port for discharging gas sucked through the suction port, wherein an edge of the discharge port is in a convex shape in the shaft direction formed by a first inclined surface of a protrusion portion which is protruded in the shaft direction from the bracket and a second inclined surface in the fan housing.

2. The apparatus of claim 1, wherein an inflection point is formed at a contact point of the first inclined surface and the second inclined surface.

3. The apparatus of claim 1, wherein the edge is formed in a 'V' shape.

4. The apparatus of claim 1, wherein the fan housing includes a combining portion which forms a receiving space of the centrifugal fan, and is formed to have an edge which is parallel with the rotation shaft from the contact point of the second inclined surface to the portion combined with the bracket.

5. The apparatus of claim 1, wherein the protrusion portion further includes a fixing means for fixing and combing the protrusion portion with the fan housing in a portion abutted on the fan housing.

6. The apparatus of claim 5, wherein the fixing means includes a fixing protrusion portion which is protruded and formed in the shaft direction, and an insertion portion which is formed in the fan housing in which the fixing protrusion portion is inserted.

7. The apparatus of claim 1, wherein the first inclined surface and second inclined surface are formed in a shape of a curved line.

8. The apparatus of claim 1, wherein end points of the first inclined surface and the second inclined surface deviate from each other.

9. A blower apparatus, including:

a pair of centrifugal fans;

a driving unit for rotating the centrifugal fan;

a bracket which combined with a side of the driving unit; and a pair of fan housings being combined with the bracket, receiving the centrifugal fan, and having a suction port formed in a shaft direction of the centrifugal fan for sucking gas by rotation of the centrifugal fan, and a discharge port formed vertically to the suction port for discharging gas sucked through the suction port, wherein an edge of the discharge port is in a convex shape in the shaft direction formed by a first inclined surface of a protrusion portion which is protruded in the shaft direction from the bracket and a second inclined surface in the fan housing.

10. The apparatus of claim 9, wherein an inflection point is formed at a contact point of the first inclined surface and the second inclined surface.

11. The apparatus of claim 9, wherein the edge is formed in a 'V' shape.

12. The apparatus of claim 9, wherein the fan housing includes a combining portion which forms a receiving space of the centrifugal fan, and is formed to have an edge which is parallel with the rotation shaft from the contact point of the second inclined surface to the portion combined with the bracket.

13. The apparatus of claim 12, wherein the protrusion portion further includes a fixing means for fixing and combing the protrusion portion with the fan housing in a portion abutted on the fan housing.

14. The apparatus of claim 13, wherein the fixing means includes a fixing protrusion portion which is protruded and formed in the shaft direction, and an insertion portion which is formed in the fan housing in which the fixing protrusion portion is inserted.

15. The apparatus of claim 9, wherein the first inclined surface and second inclined surface are formed in a shape of a curved line.

16. The apparatus of claim 9, wherein the blower apparatus is installed in an OTR microwave oven.

17. The apparatus of claim 9, wherein end points of the first inclined surface and second inclined surface deviate from each other.

18. A method for manufacturing a blower apparatus which includes a centrifugal fan, a bracket combined with a side of the driving unit, and a fan housing being combined with the bracket, receiving the centrifugal fan, the fan housing being combined with the bracket, and having a suction port formed in a shaft direction of the centrifugal fan for sucking gas by rotation of the centrifugal fan, and a discharge port formed vertically to the suction port for discharging gas sucked through the suction port, which comprises:

forming an edge of the discharge port in a convex shape in the shaft direction with a first inclined surface of a protrusion portion which is protruded in the shaft direction from the bracket and a second inclined surface in the fan housing; and forming an inflection point at the contact point of the first inclined surface and second inclined surface.

19. The method of claim 18, wherein the bracket and the fan housing are manufactured by injection molding.

* * * * *

UNITED STATES PATENT AND TRADEMARK OFFICE

CERTIFICATE OF CORRECTION

PATENT NO. : 6,677,564 B1
DATED : January 13, 2004
INVENTOR(S) : S. Sohn et al.

It is certified that error appears in the above-identified patent and that said Letters Patent is hereby corrected as shown below:

Title page,
Item [75], Inventors, "Seung-bae" should be -- Sung-Bae --.

Signed and Sealed this

Fourteenth Day of September, 2004

JON W. DUDAS
*Director of the United States Patent and Trademark Office*